United States Patent [19]

Pai et al.

[11] Patent Number: 4,988,595

[45] Date of Patent: Jan. 29, 1991

[54] CHARGE TRANSPORT LAYER CONTAINING DIFFERENT AROMATIC DIAMINE ACTIVE CHARGE TRANSPORT COMPOUNDS

[75] Inventors: Damodar M. Pai, Fairport; John F. Yanus, Webster; Paul J. DeFeo, New York, all of N.Y.

[73] Assignee: Xerox Corporation, Stamford, Conn.

[21] Appl. No.: 451,832

[22] Filed: Dec. 18, 1989

[51] Int. Cl.[5] ..... G03G 5/04

[52] U.S. Cl. ..... 430/59; 430/73

[58] Field of Search ..... 430/59, 73; 564/309

[56] References Cited

U.S. PATENT DOCUMENTS

| | | | |
|---|---|---|---|
| 4,081,274 | 3/1978 | Morgan | 96/1 PC |
| 4,265,990 | 5/1981 | Stolka et al. | 430/59 |
| 4,299,897 | 11/1981 | Stolka et al. | 430/59 |
| 4,504,564 | 3/1985 | Pai et al. | 430/132 |
| 4,833,054 | 5/1989 | Akasaki et al. | 430/59 |

*Primary Examiner*—John Goodrow

[57] ABSTRACT

An electrophotographic imaging member containing a charge generating layer and a charge transport layer, the charge transport layer comprising a film forming binder, a first aromatic diamine represented by the general formula:

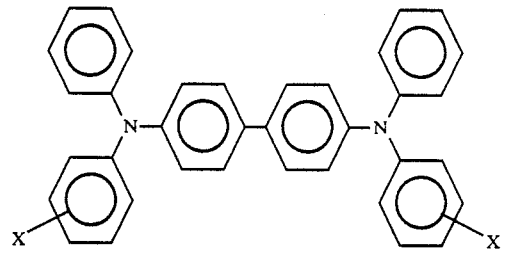

wherein X is selected from the group consisting of an alkyl group containing from 1 to 4 carbon atoms and chlorine and a second aromatic diamine represented by the general formula:

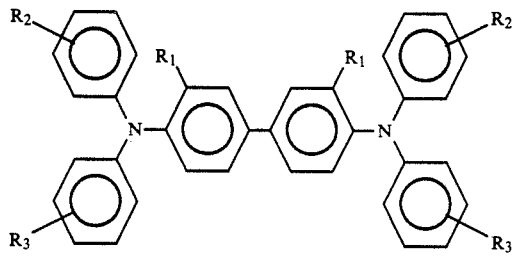

wherein $R_1$ represents an alkyl group or an alkoxy group, $R_2$ represents a hydrogen atom, an alkyl group, an alkoxy group, a halogen atom, an alkoxycarbonyl group or a substituted amino group and $R_3$ represents an alkyl group, an alkoxy group, a halogen atom, an alkoxycarbonyl group or a substituted amino group.

14 Claims, No Drawings

CHARGE TRANSPORT LAYER CONTAINING DIFFERENT AROMATIC DIAMINE ACTIVE CHARGE TRANSPORT COMPOUNDS

This invention relates in general to electrophotographic imaging members and more specifically, to imaging members having an improved charge transport layer and process for using the imaging members.

In the art of electrophotography an electrophotographic plate comprising a photoconductive insulating layer on a conductive layer is imaged by first uniformly electrostatically charging the imaging surface of the photoconductive insulating layer. The plate or photoreceptor is then exposed to a pattern of activating electromagnetic radiation such as light, which selectively dissipates the charge in the iluminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

One common type of photoreceptor is multilayered device that comprises a conductive layer, a charge generating layer, and a charge transport layer. Either the charge generating layer or the charge transport layer may be located adjacent the conductive layer. The charge transport layer can contain an active aromatic diamine small molecule charge transport compound dissolved or molecularly dispersed in a film forming binder. This type of charge transport layer is described, for example in U.S. Pat. No. 4,265,990. Although excellent toner images may be obtained with such multilayered photoreceptors, it has been found that copy quality problems can be encountered when the photoreceptor comes to rest (parked) after extensive cycling. The segment of the photoreceptor parked adjacent a corotron that has been in operation during the long copy run exhibits a print resolution or deletion deficiency which appears on the final copies as a band devoid of toner deposits. Although the corotron high voltage is turned off during the time the photoreceptor is parked, some deleterious effluents are still emitted from the shield, housing, etc. of the corotron. This effluent emission is concentrated in the region of the photoreceptor directly adjacent the corotron and renders that adjacent surface region of the photoreceptor conductive. When the machine operation is resumed for the next copy run, a loss of resolution (even deletion) is observed in the affected region. This problem has been encountered in most machine programs employing multilayered devices in which the charge transport layer contains an active aromatic diamine small molecule charge transport compound. This problem has been partially solved by employing several means such as a convective airflow (chimney effect) from the hot toner image fuser directed towards the corotron to flush out the effluents and the use of generous quantities of special coatings on the corotron housing, shield and the like.

Thus, in automatic imaging systems utilizing multilayered belt photoreceptors, resolution loss and deletion have been encountered during photoreceptor cycling. This reduces the practical value of multilayered belt photoreceptors for automatic electrophotographic copiers, duplicators and printers.

INFORMATION DISCLOSURE STATEMENT

U.S. Pat. No. 4,081,274, issued to Horgan on Mar. 28, 1978—An imaging member is disclosed comprising a first layer of electrically active charge transport material on a supporting substrate, a photoconductive layer overlying the charge transport layer and a second layer of charge transport material overlying the photoconductive layer, the photoconductive layer exhibiting the capability of photogeneration of charge carriers and injection of the charge carriers, one of the electrically active layers comprising an electrically inactive resinous material made electrically active by the addition of certain activating compounds thereto. One of the activating compounds useful as an additive to the electrically inactive polymeric material making it electrically active is N,N'-diphenyl-N,N'-bis(phenylmethyl)-[1,1'-biphenyl]-4,4'-diamine. Another compound useful as an additive to the electrically inactive polymeric material making it electrically active is another aromatic amine illustrated, for example, in column 4, line 9 through column 5, line 26. Still another aromatic diamine compound which may be added to the electrically inactive polymeric material to render it electrically active is described in column 5, line 46 through column 6, line 2. These aromatic diamines are also further discussed in column 9, line 31 through column 12, line 33.

U.S. Pat. No. 4,265,990, issued to Stolka et al. on May 5, 1981—A photosensitive member is disclosed having photoconductive layer and a charge transport layer, the charge transport layer containing an aromatic diamine.

U.S. Pat. No. 4,299,897, issued to Stolka et al. on Nov. 10, 1981—A photosensitive member is disclosed having two electrically operative layers, the first layer comprising a photoconductive layer and the second layer comprising a contiguous charge transport layer. The charge transport layer comprises an electrically inactive organic resinous material and various aromatic diamines such as N,N,N',N'-tetra-(4 methylphenyl)-[2,2'-dimethyl-1,1'-biphenyl]-4,4'-diamine or N,N'-diphenyl-N,N'-bis(4-methylphenyl)-[2,2'-dimethyl-1,1'-biphenyl]-4,4'-diamine.

U.S. Pat. No. 4,833,054, issued to Akasaki et al. on May 23, 1989—An electrophotographic photoreceptor is disclosed comprising an electrically conductive support having thereon a photosensitive layer composed of a charge generating layer and a charge transport layer, wherein the charge generating layer contains a bisazo compound and the charge transport layer contains a benzidine compound. The generic formula for the benzidine compound (an aromatic diamine) is illustrated, for example, in column 2, lines 41–58 and column 12, line 15 through column 26, line 15.

U.S. Pat. No. 4,504,564 issued to Pai et al. on Mar. 12, 1985—A process is disclosed for preparing an electrophotographic imaging member comprising providing a photoconductive layer and depositing thereon a solution of polycarbonate and substituted N,N'-diphenyl-N,N'-bis(alkylphenyl)-[1,1'-biphenyl]-4,4'-diamine in a halogenated hydrocarbon solvent and halogen-free organic solvent having a boiling point greater than the boiling of the halogenated hydrocarbon solvent to provide a charge transport layer when the solvents are removed.

Thus, there is a continuing need for electrophotographic imaging members having improved resistance to resolution loss and deletion.

SUMMARY OF THE INVENTION

It is, therefore, an object of the present invention to provide an improved electrophotographic imaging member which overcomes the above-noted disadvantages.

It is yet another object of the present invention to provide an electrophotographic imaging member exhibiting improved resistance to loss of image resolution.

It is still another object of the present invention to provide an electrophotographic imaging member exhibiting improved resistance to image deletion.

It is another object of the present invention to provide an electrophotographic imaging member possessing improved resistance against crystallization.

It is yet another object of the present invention to provide an electrophotographic imaging member that is economical.

The foregoing objects and others are accomplished in accordance with this invention by providing an electrophotographic imaging member comprising a charge generating layer and a charge transport layer, the charge transport layer comprising a film forming binder, a first aromatic diamine represented by the general formula:

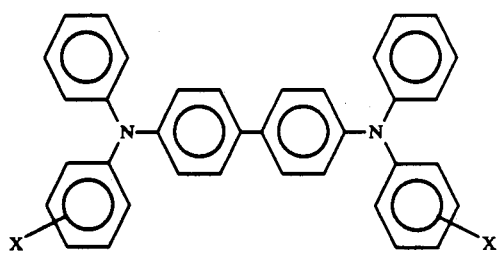

wherein X is selected from the group consisting of an alkyl group containing from 1 to 4 carbon atoms and chlorine and a second aromatic diamine represented by the general formula:

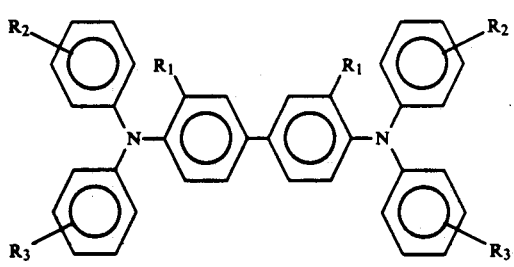

wherein $R_1$ represents an alkyl group or an alkoxy group, $R_2$ represents a hydrogen atom, an alkyl group, an alkoxy group, a halogen atom, an alkoxycarbonyl group or a substituted amino group and $R_3$ represents an alkyl group, an alkoxy group, a halogen atom, an alkoxycarbonyl group or a substituted amino group. This imaging member may be employed in an electrophotographic imaging process.

Electrostatographic imaging members are well known in the art. Electrostatographic imaging member may be prepared by various suitable techniques. Typically, a flexible or rigid substrate is provided having an electrically conductive surface. A charge generating layer is then applied to the electrically conductive surface. A charge generating lay may be applied to the electrically conductive surface prior to the application of the charge generation layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer is applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate may be in the form of an endless flexible belt, a web, a rigid cylinder, a sheet and the like.

The thickness of the substrate layer depends on numerous factors, including strength desired and economical considerations. Thus this layer for a flexible belt may be of substantial thickness, for example, about 125 micrometers, or of minimum thickness less than 50 micrometers, provided there are no adverse effects on the final electrostatographic device. The surface of the substrate layer is preferable cleaned prior to coating to promote greater adhesion of the deposited coating. Cleaning may be effected, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Mylar available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The oxidized surface inherently forms on the outer surface of most metal ground plane layers when exposed to air after deposition. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E. I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, indofast Violet Lake b, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer comprises a mixture of at least two specific types of aromatic diamine charge transporting compounds useful as an additive dissolved or molecularly dispersed in electrically inactive polymeric materials which causes these materials to become electrically active. The specific mixture of aromatic diamine charge transporting compounds are added to polymeric materials which are normally incapable of supporting the injection of photogenerated holes from the generation material and incapable of allowing the transport of these holes therethrough. This converts the electrically inactive polymeric material to a material capable of supporting the injection of photogenerated holes from the generation material and capable of allowing the transport of these holes through the active layer in order to discharge the surface charge on the active layer. The expression "Electrically active" when used to define the charge transport layer means that the material is capable of supporting the injection of photogenerated holes from the generating material and capable of allowing the transport of these holes through the active layer in order to discharge a surface charge on the active layer. The expression "Electrically inactive" when used to describe the electrically inactive organic resinous binder material which does not contain any aromatic diamine compounds of the instant invention means that the binder material is not capable of supporting the injection of photogenerated holes from the generating material and is not capable of allowing the transport of these holes through the material. An especially preferred transport layer empolyed in one of the two electricaly operative layers in the multilayered photoconductor of this invention comprises between about 25 percent and about 75 percent by weight of the specific mixture of aromatic diamine charge transporting compounds and between about 75 percent and about 25 percent by weight of a polymeric film forming resin in which the mixture aromatic amines is soluble.

The first of the two specific aromatic diamine charge transport layer compounds may represented by the general formula:

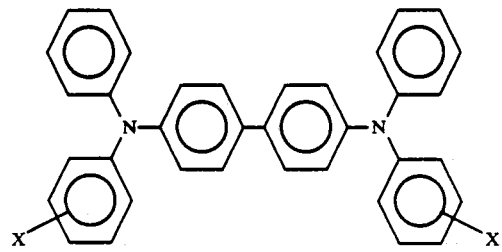

wherein X is selected from the group consisting of an alkyl group containing from 1 to 4 carbon atoms and chlorine. Examples of charge transporting aromatic amines represented by the structural formula above capable of supporting the injection of photogenerated holes and transporting the holes through the overcoating layer include N,N'-diphenyl-N,N'-bis(alkylphenyl)-(1,1'-biphenyl)-4,4'-diamine wherein the alkyl is, for example, methyl, ethyl, propyl, n-butyl, and the like, N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, and the like. Satisfactory results may be achieved with between about 20 percent and about 80 percent by weight of this first diamine based on the total weight of the diamines in the charge transport layer. When less about 20 percent by weight aromatic amine is employed, cycle-up is observed when employed in conjunction with some pigments such as trigonal selenium. Concentrations of this diamine greater than about 80 percent can result in parking deletion. The preferred optimum range of the first diamine is between about 30 and about 70 percent by weight based on the total weight of the diamines. The specific aromatic diamine charge transport layer compound illustrated in the formula above is described in U.S. Pat. No. 4,265,990, the entire disclosure thereof being incorporated herein by reference.

The second of the two specific aromatic diamine charge transport layer compounds in the charge transport layer of this invention may be represented by the general formula:

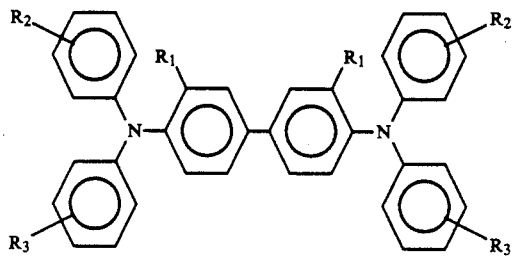

wherein wherein $R_1$, $R_2$ and $R_3$ are selected from the group consisting of hydrogen, $CH_3$, $C_2H_5$, $OCH_3$, Cl and alkoxycarbonyl. The preferred materials for the second diamine are: N,N,N',N'-tetraphenyl-[3,3'-dimethyl-1,1'-biphenyl]-4,4'-diamine; N,N'-diphenyl-N,N'-bis(2-methylphenyl)-[3,3'dimethyl-1,1'-biphenyl]-4,4'-diamine; N,N'-diphenyl-N,N'-bis(3-methylphenyl)-[3,3'-dimethyl-1,1'-biphenyl]-4,4'-diamine; N,N'-diphenyl-N,N'-bis(4-methylphenyl)-[3,3'dimethyl-1,1'-biphenyl]-4,4'-diamine; N,N,N',N'-tetra(2-methylphenyl)-[3,3'-dimethyl-1,1'-biphenyl]-4,4'-diamine; N,N'-bis(2-methylphenyl)-N,N'-bis(4-methylphenyl)-[3,3'-dimethyl-1,1'-biphenyl]-4,4'-diamine; N,N'-bis(3-methylphenyl)-N,N'-bis(2-methylphenyl)-[3,3'-dimethyl-1,1'-biphenyl]-4,4'-diamine; N,N,N',N'-tetra(3-methylphenyl)-[3,3'-dimethyl-1,1'-biphenyl]-4,4'-diamine; N,N'-bis(3-methylphenyl)-N,N'-bis(4-methylphenyl)-[3,3'-dimethyl-1,1'-biphenyl]-4,4'-diamine; and N,N,N',N'-tetra(4-methylphenyl)-[3,3'-dimethyl-1,1'-biphenyl]-4,4'-diamine. Satisfactory results may be achieved with between about 20 percent and about 80 percent by weight of this second diamine based on the total weight of the diamines in the charge transport layer. When less about 20 percent by weight aromatic amine is employed, parking deletions become severe. Concentrations of this diamine greater than about 80 percent can result in cycle-up when employed in conjunction with some pigments such as trigonal selenium. The specific aromatic diamine charge transport layer compound illustrated in the formula above is described in U.S. Pat. No. 4,299,897, the entire disclosure thereof being incorporated herein by reference.

The most preferred materials for the second diamine include: N,N,N',N'-Tetra-(4-methylphenyl)-[3,3'-dimethyl-1,1'-biphenyl]-4,4'-diamine:

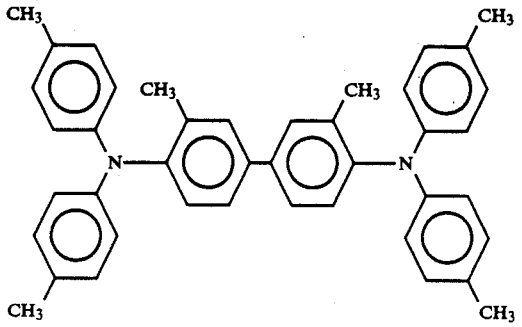

N,N'-diphenyl-N,N'-bis(4-methylphenyl)-[3,3'-dimethyl-1,1'-biphenyl]-4,4'-diamine;

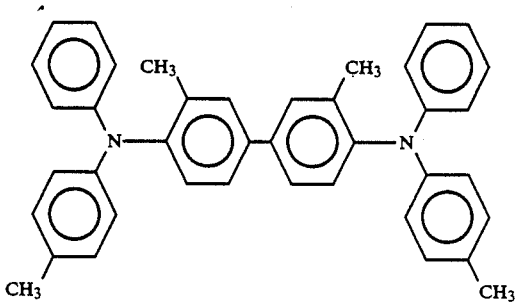

and N,N'-bis(4-methylphenyl)-N,N'-bis(4-ethylphenyl)-[3,3'-dimethyl-1,1'-biphenyl]-4,4'-diamine:

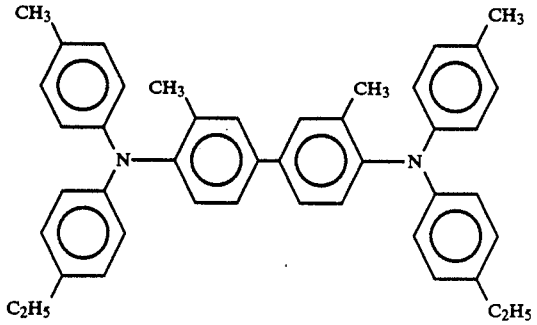

The second of the two specific aromatic diamine charge transport layer compounds is described in U.S. Pat. No. 4,299,897, the entire disclosure thereof being incorporated herein by reference. The substituents on both the first and second types of aromatic diamine molecules should be free from electron withdrawing groups such as $NO_2$ groups, CN groups, and the like.

Any suitable inactive resin binder soluble in methylene chloride or other suitable solvent may be employed in the process of this invention. Typical inactive resin binders soluble in a solvent include polycarbonate resin, polyester, polyarylate, polyacrylate, polyether, polysulfone, and the like. Molecular weights can vary from about 20,000 to about 150,000.

The preferred electrically inactive resin binder materials are polycarbonate resins having a molecular weight between about 20,000 and about 150,000, more preferably between about 50,000 and about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G., a polycarbonate resin having a molecular weight of from about 20,000 to about 50,000 available as Merlon from Mobay Chemical Company, poly(1,1-cyclohexanebis(4-phenyl)carbonate and the like.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1. In other words, the charge transport layer, is substantially nonabsorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

The photoreceptors of this invention may comprise, for example, a charge generator layer sandwiched between a conductive surface and a charge transport layer as described above or a charge transport layer sandwiched between a conductive surface and a charge generator layer. This structure may be imaged in the conventional xerographic manner which usually includes charging, optical exposure and development.

Other layers may also be used such as conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anticurl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers.

The mixture of the two specific types of active aromatic amino charge transport compounds in the charge transport layer of the photoreceptor of this invention forms a more stable, less expensive photoreceptor than photoreceptors containing only a single active aromatic amino charge transport compound in a charge transport layer. The stability improvement of photoreceptors containing the mixture is disproportionately large and unexpected. Stability improvement is especially noticeable when comparing electrophotographic imaging systems that are temporarily stopped for at least about 10 minutes following long periods of image cycling involving at least about an hour of repeated corona charging, image exposing, toner developing and toner image transfering steps and the corona charging device begins to emit oxides of nitrogen. It is not fully understood why such a dramatic improvement occurs with the photoreceptor of this invention. It is believed that the blocking of the para position is responsible for this stability. The stability improvement involves both a marked reduction in image deletion and greater resistance to crystallization of the diamines at high concentrations. This is particularly important for dip coated photoreceptors because the usual maximum limit (without the second aromatic diamine) for dip coated transport layers can result in only marginal charge carrier mobility. The second aromatic diamine additive is more expensive than the first aromatic diamine. However, the second aromatic diamine additive markedly improves the stability of transport layers containing the first aromatic diamine and does not affect the shape of the photoinduced discharge curve (PIDC) of photoreceptors utilizing transport layers containing the first aromatic diamine. Also, when used in relatively small quantities, the second aromatic diamine additive does not significantly increase costs.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

For the Examples which follow, four types of experiments were carried out to demonstrate that the mixtures of the first and second types of aromatic diamine compounds described above were compatible with each other from the point of view of charge transport (one does not function as a trap for the other) and were more stable than the first aromatic diamine from the point of view of parking deletion. The tests were: (1) a time of flight test to determine the charge carrier mobility (or carrier velocity), (2) a sensitivity test (3) a cyclic stability test in a scanner and (4) a parking deletion test.

EXAMPLE I

Five electrophotographic imaging members (A, B, C, D and E) were prepared by forming coatings using conventional techniques on a substrate comprising vacuum deposited titanium layer on a polyethylene terephthalate film (Melinex, available from E. I. duPont de Nemours & Co.). The first coating was a siloxane barrier layer formed from hydrolyzed gamma aminopropyltriethoxysilane having a thickness of 100 angstroms. The second coating was an adhesive layer of polyester resin (49,000, available from E. I. duPont de Nemours & Co.) having a thickness of 50 angstroms. The next coating was a charge generator layer containing 35% by weight vanadyl phthalocyanine particles dispersed in a polyester resin (Vitel PE100, available from Goodyear Tire and Rubber Co.) having a thickness of 1 micrometer. The top coating was a charge transport layer of a dispersion of aromatic diamine donor molecules in polycarbonate resin (Makrolon, available from Farbenfabricken Bayer A. G.) having a thickness of 20 micrometers. For each device, the molecular concentration of the aromatic diamine donor molecules was held constant and equal to that in a film containing 40 weight percent N,N'-diphenyl-N,N'-bis(3-methylphenyl)-(1,1'-biphenyl)-4,4'-diamine, based on the total weight of the charge transport layer. The "first" aromatic diamine was N,N'-diphenyl-N,N'-bis(3-methylphenyl)-(1,1'-biphenyl)-4,4'-diamine and the second aromatic diamine (when present) was N,N'-bis(4-methylphenyl)-N,N'-bis(4-ethylphenyl)-[3,3'-dimethyl- 1,1'-biphenyl]-4,4'-diamine. The fabrication procedure of the transport layer of device B is illustrated as an example. One gram of Makrolon ® polycarbonate was dissolved in 11.4 grams of methylene chloride. To this mixture was added 0.5385 gram of N,N'-diphenyl-N,N'-bis(3 methylphenyl)-(1,1'biphenyl)-4,4'diamine and 0.1483 gram of N,N'-bis(4-methylphenyl)-N,N'-bis(4-ethylphenyl)-(3,3'-dimethyl-1,1'-biphenyl)-4,4'-diamine. After dissolution, the mixture was coated on the substrate containing the charge generator layer using a 3 mil Bird film applicator. The film was dried in a forced air oven at 100° C. for 20 minutes. These five photoreceptors were tested for charge carrier mobility by measuring time of flight. The time of flight experiments were carried out on a sandwich structure consisting of the electrically conductive titanium coated substrate, the barrier layer, the adhesive layer, the charge generator layer and the charge transport layer (the devices under study) and a vacuum deposited semi-transparent gold electrode. This sandwich was connected in a circuit containing a voltage power supply and a current measuring series resistance. The principal underlying this time of flight test is that when the gold electrode is biased negatively and the device exposed to a flash of light, holes photogenerated in the generator layer are injected into and drift through the transport layer. The electric current due to the carrier transit is time resolved and displayed on an oscilloscope. A constant current followed by a sharp drop-off was observed. The point at which the sharp drop occurs is the transit time. The transit time $t_{tr}$ is equal to the thickness of the transport layer divided by velocity, i.e. $t_{tr}$=(TL thickness)/velocity. The relationship between the velocity and charge carrier mobility is velocity=(mobility)·(electric field). The formulations of the transport layers of the five devices and the results of the time of flight experiments carried out on the five devices are tabulated in the Table 1 below. The hole mobility values are within the error bars of the experiment.

TABLE 1

| Device | Transport Layer Composition by wt. % Resin:1st Diamine:2nd Diamine | Hole Mobility in $Cm^2$/Volt Second At $10^5$Volts/cm |
|---|---|---|
| A | 60:40:0 | $4.8 \times 10^{-6}$ |
| B | 59:32:9 | $3.0 \times 10^{-6}$ |
| C | 59:25:16 | $4.2 \times 10^{-6}$ |
| D | 58:14:28 | $3.7 \times 10^{-6}$ |
| E | 57:6:37 | $5.0 \times 10^{-6}$ |

The results shown in Table 1 clearly indicate that the first and second aromatic diamine molecules can be mixed at various concentrations without one molecule acting as a trap to the other one.

EXAMPE II

The devices described in Example I (without a gold electrode) were mounted in a scanners and tested for sensitivity. The device is mounted on a cylindrical aluminum drum which is rotated on a shaft. The film is charged by a corotron mounted along the circumference. The surface potential is measured as a function of time by several capacitively coupled probes placed at different locations around the shaft. The probes are calibrated by applying known potentials to the drum substrate. The film on the drum is exposed and erased by light sources located at appropriate positions around the drum. The measurement consists of charging the photoconductor device in a constant current or voltage mode. As the drum rotates, the initial charging potential is measured by probe 1. Further rotation leads to the exposure station, where the photoconductor device is exposed to monochromatic radiation of known intensity. The surface potential after exposure is measured by probes 2 and 3. The device is finally exposed to an erase lamp of appropriate intensity and any residual potential is measured by probe 4. The process is repeated with the magnitude of the exposure automatically changed during the next cycle. A photo induced discharge characteristics (PIDC) is obtained by plotting the potentials at probes 2 and 3 as a function of exposure. The five devices were charged to a negative polarity by corotron charging and discharged by monochromatic light in the visible and in the IR portion of the light spectrum. The sensitivities as gathered from the initial discharge rate were essentially within the error bars of the experimental technique and are set forth in Table 2 at 775 nm and 600 nm.

TABLE 2

| Device | Transport Layer Composition by wt. % Resin:1st Diamine:2nd Diamine | Initial Discharge Rate in Volts/(Ergs $cm^{-2}$) at 775 nm | Initial Discharge Rate in Volts/(Ergs $cm^{-2}$) at 600 nm |
|---|---|---|---|
| A | 60:40:0 | 105 | 95 |
| B | 59:32:9 | 107 | 97 |
| C | 59:25:16 | 102 | 93 |
| D | 58:14:28 | 110 | 99 |
| E | 57:6:37 | 100 | 91 |

The devices charged capacitively and therefore were equivalent. This test further establishes that the sensitivities are not altered by employing a mixture of diamines 1 and 2 (Devices B, C, D and E) instead of diamine 1 alone (Device A).

EXAMPLE III

The devices described in Example I (without a gold electrode) were subjected to charge, expose and erase cycles in a scanner described in Example II. The test was conducted for 10,000 continuous cycles and found to show neither residual build called cycle-up nor any drop in charging potential (i.e. cycle-down).

EXAMPLE IV

The five devices described in Example I (without a gold electrode) were subjected to parking deletion tests. To understand the significance of the parking deletion test, one must be familiar with the normal operation conditions of electrophotographic copying machines and printers. In these machines, image deletion is observed on copies made after the machine had previously been in operation for several hours and then shut down. The deletion corresponds to the parked photoconductor surface directly adjacent the machine corotrons is believed to be caused by exposure to oxides of nitrogen emitted from the corotron shield and housing. Although, each corotron is not operating when the photoreceptor is parked (stationary), the oxides of nitrogen emitted during shut down were the ones adsorbed in the corotron housing during the period when the corotron was operational, i.e. prior to the shut down. This concentrated emission results in a "temporary" increase of surface conductivity in the photoreceptor. It is believed that the conductivity increase is caused by the creation of radical cations in a region encompassing several monolayers of the charge transport layer close to the outer imaging surface and is not removed by the cleaning action of the photoreceptor cleaning blades or by an isopropanol wash. The eventual recovery of the transport layer to an insulating state in the exposed region may be caused by either recombination of the cation radical with the counter negative ion or by a transformation to a nitrated species of the original donor molecules. The increase in surface conductivity during parking results in either a resolution loss or a band of deletion depending on how long the corotron has been in operation prior to shut down and the duration of parking prior to resumption of machine operation. This deletion problem is referred to as "parking deletion".

The parking deletion test conducted on the five devices described in Example I comprised first cleaning the surface of each photoreceptor to be tested by wiping it with a paper towel soaked in isopropanol followed by a quick drying by blowing air over the devices to remove any degraded material already on the surface. A negative corotron was operated (with the high voltage on) opposite a grounded electrode for several hours, shut off and then placed (parked) for 30 minutes on the imaging surface of each photoreceptor under study. Only a short segment of the device film was thus exposed to the effluents from the corotron. Unexposed regions on either side of the exposed region were used as a control. After exposure to the corotron emissions, each photoreceptor was tested for positive charge acceptance in a scanner to measure the surface conductivity of the transport layer. An undegraded surface behaves like an insulator and positive charge acceptance occurs. A degraded, conductive surface results in an inability to accept charge. The extent of positive charge acceptance before (virgin state) and after exposure to the parked corotron was compared. The positive charge acceptance for the device in the virgin and degraded states were-measured one second after the charging step. The time for a device in the degraded, conductive state (subsequent to exposure by the parked corotron) to recover to the virgin state (prior to exposure by the parked corotron) was also measured. Shorter recovery times indicate improved devices. The results are compiled in Table 3 below.

TABLE 3

| Device | Transport Layer Composition by wt. % Resin:1st Diamine:2nd Diamine | Positive charge voltage of virgin state | Positive charge voltage soon after corotron exposure | Recovery time in minutes |
|---|---|---|---|---|
| A | 60:40:0 | 1000 | 100 | 300 |
| B | 59:32:9 | 1050 | 500 | 20 |
| C | 59:25:16 | 990 | 700 | 8 |
| D | 58:14:28 | 1010 | 800 | 6 |
| E | 57:6:37 | 1000 | 800 | 5 |

The results in Table 3 show that the mixtures of N,N'-diphenyl-N,N'-bis(3-methylphenyl)-(1,1'-biphenyl)-4,4'-diamine and N,N'-bis(4-methylphenyl)-N,N'-bis(4-ethylphenyl)-[2,2'-dimethyl-1,1'-biphenyl[-4,4'-diamine are less prone to exhibiting increased conductivity usually caused by parking deletion and recover more rapidly.

EXAMPLE V

The experiments described in Examples I through IV were next repeated but with mixtures of N,N'-diphenyl-N,N'-bis(3-methylphenyl)-(1,1'-biphenyl)-4,4'-diamine and N,N,N',N'-Tetra-(4-methylphenyl)-[3,3'-dimethyl-1,1'-biphenyl]-4,4'-diamine instead of with mixtures of N,N'-diphenyl-N,N'-bis(3-methylphenyl)-(1,1'-biphenyl)-4,4'-diamine and N,N'-bis(4-methylphenyl)-N,N'-bis(4-ethylphenyl)-[3,3'-dimethyl-1,1'-biphenyl]-4,4'-diamine with similar results. The xerographic sensitivity, cyclic stability and charge carrier mobility of the devices containing mixtures of N,N'-diphenyl-N,N'-bis(3-methylphenyl)-(1,1'-biphenyl)-4,4'-diamine and N,N,N',N'-Tetra-(4-methylphenyl)-[3,3'-dimethyl-1,1'-biphenyl]-4,4'-diamine are essentially equivalent to the device containing N,N'-diphenyl-N,N'-bis(3-methylphenyl)-(1,1'-biphenyl)-4,4'-diamine (Device A) alone whereas the stability against parking deletion was substantially increased.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a charge generating layer and a charge transport layer, said charge transport layer comprising a film forming binder, a first aromatic diamine represented by the general formula:

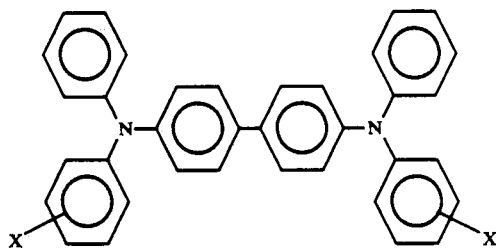

wherein X is selected from the group consisting of an alkyl group containing from 1 to 4 carbon atoms and chlorine and a second aromatic diamine represented by the general formula:

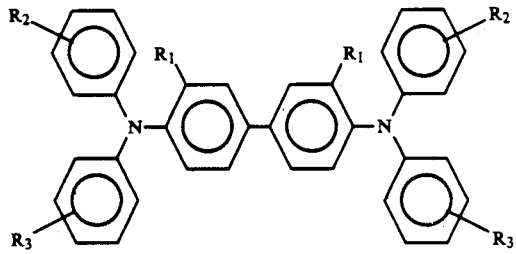

wherein $R_1$ represents an alkyl group or an alkoxy group, $R_2$ represents a hydrogen atom, an alkyl group an alkoxy group, a halogen atom, an alkoxycarbonyl group or a substituted amino group and $R_3$ represents an alkyl group an alkoxy group, a halogen atom, an alkoxycarbonyl group or a substituted amino group.

2. An electrophotographic imaging member according to claim 1 wherein said charge transport layer comprises N,N'-diphenyl-N,N'-bis-(alkylphenyl)-[1,1'-biphenyl[-4,4'diamine as said first diamine and a para substituted N,N,N',N'-tetraaryl-bitolyldiamine as said second diamine.

3. An electrophotographic imaging member according to claim 2 wherein said charge transport layer comprises between about 20 percent and about 80 percent by weight N,N'-diphenyl-N,N'-bis-(alkylphenyl)-[1,1'-biphenyl]-4,4'diamine and about 80 percent and about 20 percent by weight para substituted N,N,N',N'-tetraaryl-bitolydiamine based on the total weight of the aromatic diamines.

4. An electrophotographic imaging member according to claim 1 wherein said charge transport layer comprises between about 20 percent and about 80 percent by weight of said first aromatic diamine and about 80 percent and about 20 percent by weight of said second aromatic diamine based on the total weight of the aromatic diamines.

5. An electrophotographic imaging member according to claim 1 wherein said film forming binder is a polycarbonate resin.

6. An electrophotographic imaging member according to claim 1 wherein said charge transport layer comprises N,N'-diphenyl-N,N'-bis(3-methylphenyl)-(1,1'-biphenyl)-4,4'-diamine as said first diamine and N,N'-bis(4-methylphenyl)-N,N'-bis(4-ethylphenyl)-[3,3'-dimethyl-1,1'-biphenyl]-4,4'-diamine as said second diamine.

7. An electrophotographic imaging member according to claim 1 wherein said charge transport layer comprises N,N'-diphenyl-N,N'-bis(3-methylphenyl)-(1,1'-biphenyl)-4,4'-diamine as said first diamine and N,N,N',N'-Tetra-(4-methylphenyl)-[3,3'-dimethyl-1,1'-biphenyl]-4,4'-diamine as said second diamine.

8. An electrophotographic imaging process comprising providing an electrophotographic imaging member comprising a charge generating layer and a charge transport layer, said charge transport layer comprising a film forming binder, a first aromatic diamine represented by the general formula:

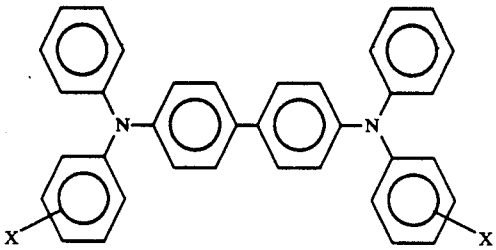

wherein X is selected from the group consisting of an alkyl group containing from 1 to 4 carbon atoms and chlorine and a second aromatic diamine represented by the general formula:

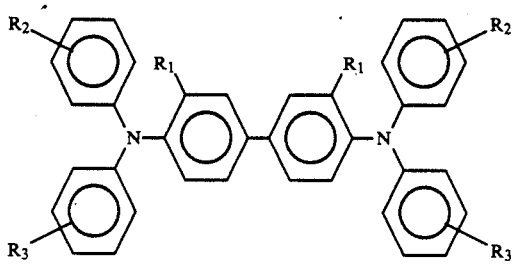

wherein $R_1$ represents an alkyl group or an alkoxy group, $R_2$ represents a hydrogen atom, an alkyl group, an alkoxy group, a halogen atom, an alkoxycarbonyl group or a substituted amino group and $R_3$ represents an alkyl group, an alkoxy group, a halogen atom, an alkoxycarbonyl group or a substituted amino group, depositing a uniform electrostatic charge on said imaging member with a corona charging device, exposing said imaging member to activating radiation in image configuration to form an electrostatic latent image on said imaging member, developing said electrostatic latent image with electrostatically attractable marking particles to form a toner image, transfering said toner image to a receiving member and repeating said depositing, exposing, developing and transfering steps for at least one hour until said corona charging device begins to emit oxides of nitrogen, temporarily stopping said depositing, exposing, developing and transfering steps for at least 10 minutes, and resuming said depositing, exposing, developing and transfering steps.

9. An electrophotographic imaging process according to claim 8 wherein said charge transport layer comprises N,N'-diphenyl-N,N'-bis-(alkylphenyl)-[1,1'-biphenyl]-4,4'-diamine as said first diamine and a para substituted N,N,N',N'-tetraaryl-bitolyldiamine as said second diamine.

10. An electrophotographic imaging process according to claim 9 wherein said charge transport layer comprises between about 20 percent and about 80 percent by weight N,N'-diphenyl-N,N'-bis-(alkylphenyl)-[1,1'-biphenyl]-4,4'diamine and about 80 percent and about 20 percent by weight para substituted N,N,N',N'-tetraaryl-bitolyldiamine based on the total weight of the aromatic diamines.

11. An electrophotographic imaging process according to claim 8 wherein said charge transport layer comprises betwen about 20 percent and about 80 percent by weight of said first aromatic diamine and about 80 percent and about 20 percent by weight of said second aromatic diamine based on the total weight of the aromatic diamines.

12. An electrophotographic imaging process according to claim 8 wherein said film forming binder is a polycarbonate resin.

13. An electrophotographic imaging process according to claim 8 wherein said charge transport layer comprises N,N'-diphenyl-N,N'-bis(3-methylphenyl)-(1,1'-biphenyl)-4,4'-diamine as said first diamine and N,N'-bis(4-methylphenyl)-N,N'-bis(4-ethylphenyl)-[3,3'-dimethyl-1,1'-biphenyl]-4,4'-diamine as said second diamine.

14. An electrophotographic imaging process according to claim 8 wherein said charge transport layer comprises N,N'-diphenyl-N,N'-bis(3-methylphenyl)-(1,1'-biphenyl)-4,4'-diamine as said first diamine and N,N,N',N'-Tetra-(4-methylphenyl)-[3,3'-dimethyl-1,1'-biphenyl]-4,4'-diamine as said second diamine.

* * * * *